United States Patent [19]

Berthiaume

[11] Patent Number: 4,485,968

[45] Date of Patent: Dec. 4, 1984

[54] BOILER NOZZLE

[75] Inventor: Camille J. Berthiaume, Hampton, N.H.

[73] Assignee: Columbia Chase Corporation, Braintree, Mass.

[21] Appl. No.: 415,389

[22] Filed: Sep. 7, 1982

[51] Int. Cl.[3] ..... B05B 7/06

[52] U.S. Cl. ..... 239/8; 239/427; 239/520; 239/402; 239/11

[58] Field of Search ..... 239/530, 402, 403, 427, 239/429, 430, 432, 433, 520, 8, 11

[56] References Cited

U.S. PATENT DOCUMENTS

| | | | |
|---|---|---|---|
| 1,669,810 | 4/1926 | Clapham | 239/433 X |
| 1,745,329 | 4/1927 | Hammer | 239/520 X |
| 1,826,776 | 7/1928 | Gunther | 239/427 X |
| 2,276,131 | 5/1938 | Waint | 239/430 X |
| 2,973,150 | 5/1958 | Golec | 239/520 X |

*Primary Examiner*—Andres Kashnikow
*Assistant Examiner*—Kevin P. Weldon
*Attorney, Agent, or Firm*—Andrew F. Kehoe

[57] ABSTRACT

A versatile mixing nozzle for dispensing polyphase fuels into a combustion zone of a boiler. The nozzle is characterized by a plurality of mixing chambers, a relatively low pressure-drop spray nozzle design and a stationary dispersing disk and radiation-protective shield partially projecting in front of the nozzle outlet ports.

7 Claims, 8 Drawing Figures

BOILER NOZZLE

BACKGROUND OF THE INVENTION

The subject invention relates to an improved nozzle for use in dispersing fuel, especially polyphase fuels, into a combustion boiler. It has been a problem to provide a dispersing nozzle that achieves excellent results with a variety of polyphase fuels and can operate over a substantial range of fuel flow rates. It is particularly desirable that such a nozzle be resistant to rapid wear by solid-bearing fuels, e.g., coal-bearing slurries. It also should be able to premix, or maintain a suitable mix, of a polyphase coal mixture.

One problem with earlier nozzles is that they utilized a relatively high velocity in the nozzle head, thereby, increasing erosion. Yet, such a high velocity was designed to achieve the desirable degree of dispersion and mixing behind the nozzles.

SUMMARY OF THE INVENTION

It is a principal object of the invention to provide an improved mixing nozzle for use in feeding combustible fuel to a boiler and dispersing the fuel into the boiler.

Another object of the invention is to provide such a nozzle with a post-nozzle fuel-dispersing means.

Still another object of the invention is to provide improved polyphase fuel dispersing means.

Other objects of the invention will be obvious to those skilled in the art on their reading of this disclosure The above objects have been substantially achieved by construction of a mixing nozzle which comprises an improved interior fuel mixing means and a post-nozzle fuel deflector. It relies less upon its nozzle effect, i.e., the pressure drop and expansion effects characteristic of nozzles, for its efficency than have dispersing nozzles of the prior art.

The invention is based, in part, on the discovery that polyphase fuels such as oil-water emulsions, coal-oil-water mixtures may be dispersed and shredded by a mechanical impact on a dispersing member mounted proximate to the fuel outlet ports from the nozzle. Apparently, the phase interfaces aid the dispersing action.

Another valuable feature of the nozzle is a gas-aspirator or syphon construction which forms means to mix steam and air with the fuel mixture.

The pressure drop across the entire nozzle assembly is conveniently between 20 and 100 pounds per square inch usually and preferably from about 25 to 50 pounds per square inch. Although, the illustrated nozzle assembly will be seen to have six nozzle orifices, the nozzle assembly works well with somewhat more or somewhat fewer orifices. Six to twelve such orifices are preferred.

ILLUSTRATIVE EMBODIMENT OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that other skilled in the art will more fully understand the invention and the principles thereof and will be able to modify it and embody it in a variety of forms, each as may be best suited in the condition of a particular case.

IN THE DRAWINGS

Figure 1:
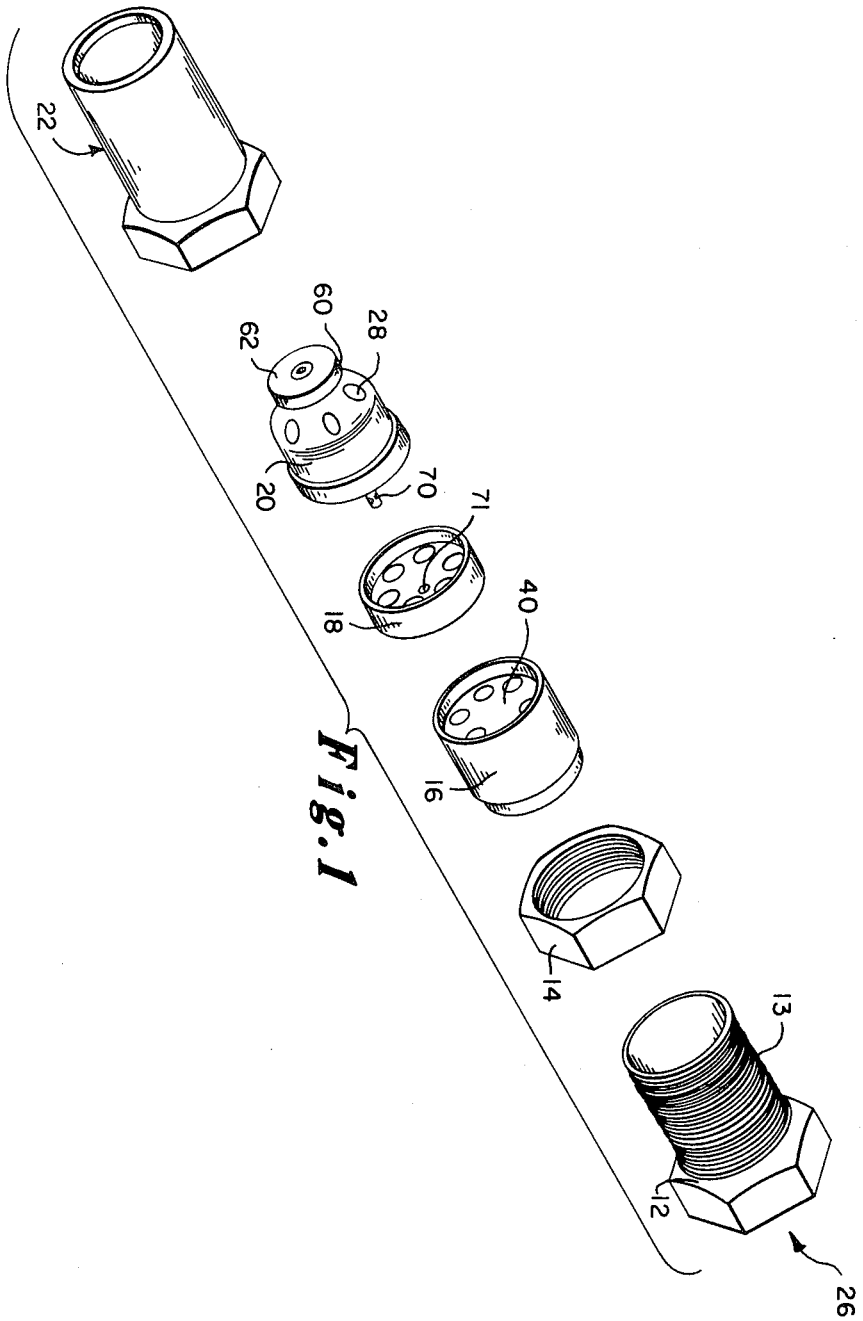
FIG. 1 is an exploded view, in perspective, of a nozzle of the invention.
Figure 2:
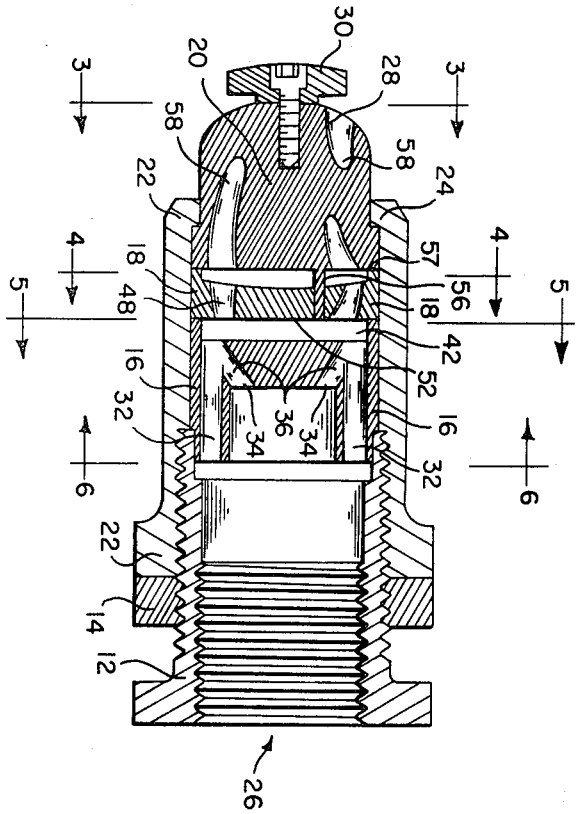
FIG. 2 is a section, in elevation, of the nozzle of FIG. 1.

Referring to FIG. 1, it is seen that a nozzle assembly 10 is comprises of a fuel line adaptor 12 which comprises an exterior thread 13. Thread 13 is adapted to screw into an interior thread within housing member 22 so that nozzle members 20, 18, 16, and 14 (each of which is more particularly identified below) are held securely, as seen in FIG. 2, between a flanged lip 24 of housing 22 and fuel line adaptor 12.

The resulting construction provides a conduit of changing configuration for transporting a fuel mixture entering nozzle Assembly 10 at 26 and exiting into a combustion chamber from nozzle member 22 through orifices 28.

A fuel deflector means 30 is mounted on the nozzle member 20 in such a way that the fuel stream, upon leaving the nozzle, hits the periphery of the deflector 30 and is further dispersed. The multi-phase nature of the fuel stream enhances this dispersing procedure.

This post-nozzle dispersion procedure allows the flow paths through the nozzle to be rather large in cross-section and permits a relatively low-velocity and low-abrasion action which is particularly beneficial with solid-bearing fuels.

Figure 5:
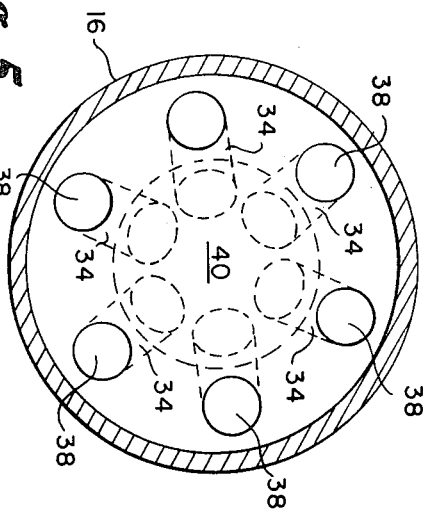
FIG. 5 is a section taken through line 5:5 of FIG. 2.
Figure 6:
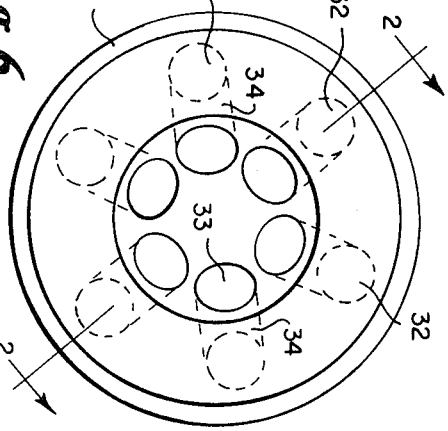
FIG. 6 is a section taken through line 6:6 of FIG. 2.
Figure 7:
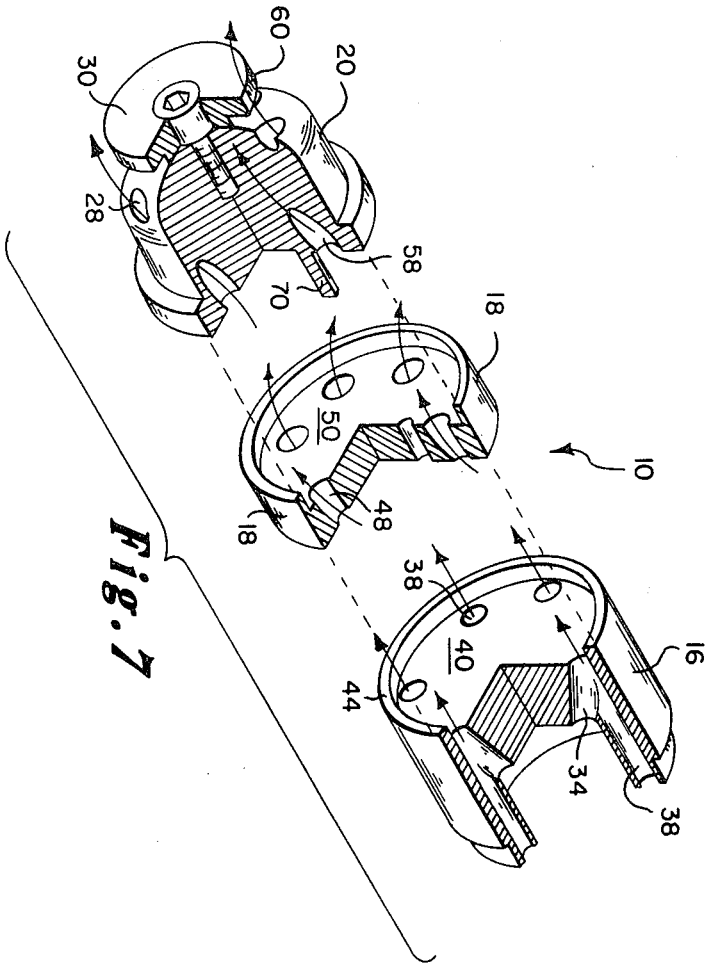
FIG. 7 is an exploded isometric view with a quarter section removed.

Nevertheless, it has been found advantageous to assume adequate premixing of multiphase fuels within the nozzle assembly structure by using a multiple-mixing procedure as follows:

Fuel entering at 26 encounters mixing head 16 which is shown in FIG. 1 and is shown, also and in more detail, in FIGS. 5 and 6 and in FIG. 2.

Figure 8:
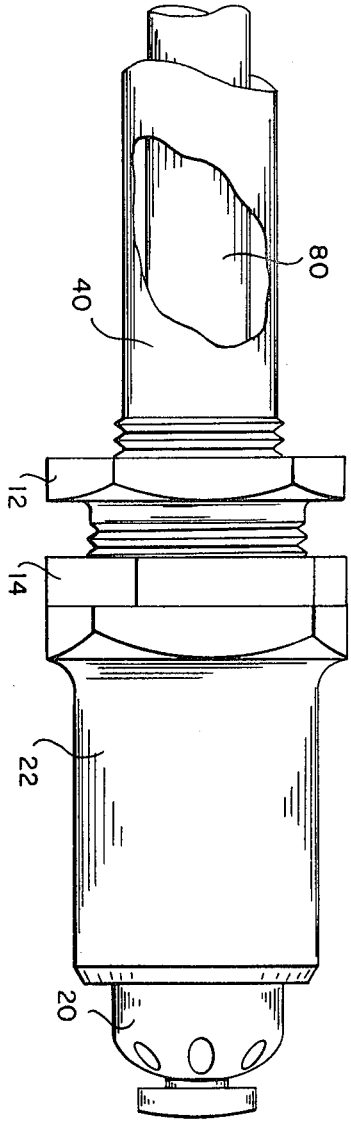
FIG. 8 shows one particularly beneficial way of using the nozzle of the invention in conjunction with a gas/fuel supply line.

FIG. 8 shows how steam or air may be transported through an inner conduit 80 to a series of interior channels 34 of mixing head 16. This gas is under higher pressure than fuel directed through exterior pipe 82 into channels 32. The resulting aspirating action also aids mixing.

Fuel encountering mixing-head 16 either enters (1) a series of outer channels 32 mounted about the periphery of mixing head 16 or (2) a series of recessed interior channels 34. Fuel if already containing gas may enter both channels 32 and 34. The channels 32 proceed directly forward to the fuel exit ports 38 front face 40 of mixing head 16. However, the interior channels 34 are sloped outwardly from their interior entrance ports at an angle to merge with channels 32 just before, or at, ports 38. Thus, the fluid receives a substantial premixing with gas within mixing head 16.

This mixing is enhanced by providing at least one thin mixing zone, e.g., 42, formed between mixing head 16 and a flow director 18. The zone is conveniently formed by a spacer lip 44 extending forward from mixing head 16 to about the outer periphery of flow director 18.

Figure 4:
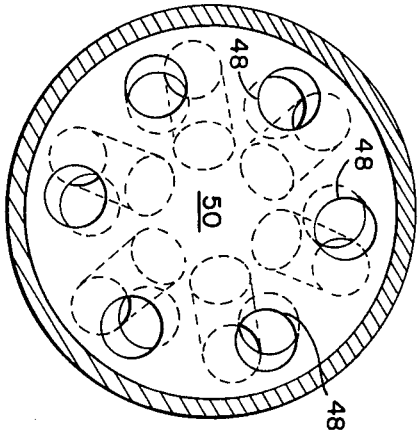
FIG. 4 is a section taken through line 4:4 of FIG. 2.

On leaving mixing zone 42, the fuel mixture flows through a series of conduits 48 in flow director 18 which forms means to impact a controlled "swirl" to the fuel. Conduits 48 are canted, as shown in FIG. 4, at a compound angle that tends to be counterclockwise and inward toward the center of rear face 52 as they progress from front face 50 to rear face 52. The angle is about 12 to 20 degrees to an axial line through the nozzle assembly 10.

It will be noticed that the relative position of members 16 to 18 can be freely determined, depending upon the characteristics of a particular fuel mixture, by mere tuning of member 16 with respect to member 18 before locking the assembly within the housing. This allows selection of preferred mixing characteristics.

On the other hand, it is often desirable to utilize a locking pin 70, offset from the center of nozzle member 20, in conjunction with a keyport 71 in member 18 to fix the relative position of nozzle members 20 and 18.

In any event, it is advantageous to have substantial offset of orifices entering or leaving a mixing zone in order to facilitate mixing and avoid short-circuiting of the zone by the fuels.

Fuel on leaving conduits 48 is received in another mixing zone 56 between tangential flow director and nozzle member 20. Fuel entering zone 56 from conduits 48 is further mixed in this zone before it proceeds through conduits 58 terminating in nozzle ports 28. Mixing zone 56 is caused by circumferential lip 57 on flow director 18 bearing against nozzle member 20.

Figure 3:
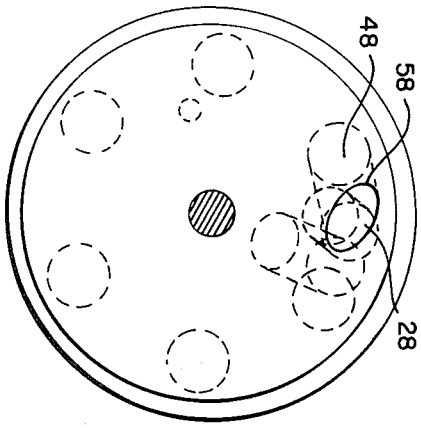
FIG. 3 is a section taken through line 3:3 of FIG. 2.

As seen in FIG. 3, conduits 58 and 48 are conveniently offset to enhance mixing but each set of conduits is advantageous arranged to promote the same swirling action of fluid leaving the conduits so that a swirling motion is imparted to the mixed fuel as it comes out of the nozzle ports 28. It is noted that FIG. 2 is schematic in this respect and the swirl configuration of conduits 58 is best seen with reference to FIG. 3.

On coming out of nozzle ports, 28, the fuel streams impinge on edge 60 of fixed dispersing disk 30, thereby shredding the fuel stream and aiding the dispersion. It is believed that phase distinctions in the multiphase fuel mixtures provide interfaces which aid shredding and dispersion by fixed disk 30.

This the assembly disclosed above provides excellent mixing and dispersing action and is less dependent on pressure drop across the nozzle exists for dispersing the polyphase fuel. This allows a greater range of fuel volume to be handled and also reduces erosion of the nozzle.

The individual conduits are typically about 0.5 centimeters in diameter for a nozzle that can handle such ranges as from 5 to 60 gallons per hour of fuel depending upon the viscosity of the fuel being dispersed. However, much higher volumes of oil can be used. In any event, a major feature of the invention is that a wide range of flow may be accomodated without substantial loss of combustion efficiency.

The presently disclosed nozzle is particularly volumable in burning of coal-oil-water slurries carrying between 30 and 60% by weight of coal.

It is understood that the following claims are intended to cover all of the generic and specific features of the invention herein described and all statements of the scope of the invention which might be said to fall therebetween.

What is claimed is:

1. A mixing nozzle assembly for use in dispensing a combustible fuel into a combination zone comprising means for mixing said fuel within said assembly, said mixing means comprising:

(a) dual conduit means forming means to asperate a fuel in one of said dual conduits with aspirating fluid in another of said conduits, (b) a first mixing zone in which said asperated fuel is mixed, (c) nozzle means which discharge said fuel into said boiler, (d) a dispersing means partially placed in the flow path of fluid being discharged into said boiler, and forming means to further disperse said fluid;

(e) and wherein said nozzle comprises means to disperse said fuel, in a series of streams, the inner portion of each said stream of which impact said dispersing means at a uniform angle.

2. A mixing nozzle assembly for use in dispensing a combustible fuel into a combustion zone comprising means for mixing said fuel within said assembly, said mixing means comprising:

(a) dual conduit means forming means to asperate a fuel in one of said dual conduits with aspirating fluid in another of said conduits, (b) a first mixing zone in which said asperated fuel is mixed, (c) nozzle means which discharge said fuel into said boiler, (d) a dispersing means partially placed in the flow path of fluid being discharged into said boiler, and forming means to further disperse said fluid.

(e) a second mixing zone between said mixing zone and said nozzle; and (f) wherein said nozzle comprises means to disperse said fuel, in a series of streams, the inner portion of each said stream of which impact said dispersing means at a uniform angle.

3. A process for feeding a polyphase fuel mixture into a boiler through an outlet of a nozzle assembly in a dispersed form which facilitates combustion of said mixture, said process comprising the steps of:

(a) feeding a polyphase fuel mixture into said nozzle assembly, (b) utilizing a plurality of conduits and two mixing zones as a mixing means within said nozzle assembly to assure a thoroughly mixed fuel is supplied to the nozzle outlet, and (c) discharging said fuel in a plurality of streams in a swirl pattern against an outer edge of a dispersing member mounted in front of, and proximate to, said nozzle assembly outlet.

4. A process as defined in claim 3 wherein said fuel is discharged against said dispersing member in a series of streams mounted around said dispersing member and directed at a swirling angle onto said edge.

5. A process as defined in claim 4 wherein a portion of each said stream nearest the axis of said nozzle assembly impacts said dispersing member.

6. A process as defined in claims 3, 4 or 5 wherein said fuel flow rate is from about 5 to about 50 gallons per hour and said nozzle conduits are about one-half of a centimeter in diameter.

7. A mixing nozzle assembly for use in dispensing a combustible fuel into a combustion zone, said mixing nozzle comprising:

(a) dual conduit means forming means to aspirate a fuel from one of said dual conduits by aspirating fluid in another of said conduit means;

(b) a first mixing zone positioned at the exit of said dual conduit means;

(c) a second mixing zone forming means to mix said fuel subsequent to being passed through a swirl-imparting passage between said first and second mixing zones;

(d) nozzle means which discharge said fuel mix into said combustion zone and which also comprise swirl-imparting conduits therein; and (e) a dispersing means partially placed in the flow path of a fluid being discharged into a combustion zone, and forming means to further disperse said fluid.

* * * * *

UNITED STATES PATENT AND TRADEMARK OFFICE

CERTIFICATE OF CORRECTION

PATENT NO. : 4,485,968

DATED : December 4, 1984

INVENTOR(S) : Camille J. Berthiaume

It is certified that error appears in the above-identified patent and that said Letters Patent are hereby corrected as shown below:

Col. 1, line 36 insert --the-- before "characteristic

Col. 2, line 19 change "comprises" to --comprised--

Col. 3, line 5 change "impact" to --impart--

Col. 3, line 35 change "advantageous" to --advantageously--

Col. 3, line 47 change "This" to --Thus--

Col. 4, line 6 change "asperate" to --aspirate--

Col. 4, line 9 change "asperated" to --aspirated--

Col. 4, line 24 change "asperate" to --aspirate--

Col. 4, line 27 change "asperated" to --aspirated--

Col. 3, line 49 change "exists" to --exits--

Signed and Sealed this

*Eighteenth* Day of *June 1985*

[SEAL]

*Attest:*

DONALD J. QUIGG

*Attesting Officer* *Acting Commissioner of Patents and Trademarks*